United States Patent [19]

McGhee et al.

[11] Patent Number: 4,502,629

[45] Date of Patent: Mar. 5, 1985

[54] NOZZLE ASSEMBLY FOR ELECTROSTATIC SPRAY GUNS

[75] Inventors: Edward C. McGhee, Amherst; Harold D. Beam, Kipton, both of Ohio

[73] Assignee: Nordson Corporation, Amherst, Ohio

[21] Appl. No.: 458,911

[22] Filed: Jan. 18, 1983

[51] Int. Cl.[3] ..... B05B 5/02

[52] U.S. Cl. ..... 239/3; 239/11; 239/705; 239/296; 239/553.3; 239/590.3

[58] Field of Search ..... 239/690, 697, 704, 705, 239/706, 707, 708, 291, 296, 504, 553.3, 590.3, 3, 11

[56] References Cited

U.S. PATENT DOCUMENTS

| | | | |
|---|---|---|---|
| 2,060,894 | 11/1936 | Potter | 239/301 |
| 2,303,280 | 11/1942 | Jenkins | 239/296 |
| 4,241,880 | 12/1980 | Hastings | 239/691 |

FOREIGN PATENT DOCUMENTS

| | | | |
|---|---|---|---|
| 0468642 | 10/1950 | Canada | 239/296 |

*Primary Examiner*—Andres Kashnikow

*Attorney, Agent, or Firm*—Wood, Herron & Evans

[57] ABSTRACT

An air atomizing nozzle assembly for electrostatic spray guns. The nozzle assembly includes a fluid tip through which liquid coating material is emitted, an air cap having openings through which pressurized air passes to atomize the liquid coating material emitted from the nozzle and having a pair of opposed air horns through which pressurized air passes to shape the atomized coating material into a flat fan spray pattern, and a retaining ring for securing the air cap to the gun barrel and fluid tip. An annular diffuser is located within an internal chamber in the nozzle assembly which receives the prezzurized fan-shaping air from a passageway passing through the barrel of the gun, redirects it, and equalizes the flow of the fan-shaping air to the opposed air horns. The present invention is particularly useful in applications having low liquid coating material flow rates on the order of less than about 3 fluid ounces of material per minute.

7 Claims, 3 Drawing Figures

NOZZLE ASSEMBLY FOR ELECTROSTATIC SPRAY GUNS

BACKGROUND OF THE INVENTION

This invention relates to electrostatic spray systems and, more particularly, to a nozzle assembly for electrostatic spray guns. More particularly, this invention relates to an external air atomizing and fan-shaping nozzle assembly for electrostatic spray guns useful in applications involving relatively low liquid coating material flow rates.

In conventional electrostatic spray systems, fluid coating material such as paint, varnish, lacquer and the like is passed through the barrel of a spray gun, into a fluid tip which is threaded at its rear into a counterbore in the forward end of the barrel and through and out of a small diameter orifice at the forward end of the fluid tip. An air cap surrounds the forward end of the fluid tip and includes a central bore surrounding the fluid tip so as to define an annular air passage around the fluid tip orifice. Air issuing from this annular passage impacts with the stream of material issuing from the material orifice of the fluid tip to at least coarsely atomize the material stream. There may be additional openings or ports in the air cap to further atomize the liquid coating material. The air cap includes a pair of opposed air horns which include pairs of ports through which pressurized air likewise passes. This air is used to change the conical shaped atomized spray of material issuing from the fluid tip into a flat fan for better coverage of the part to be coated. A trigger operated valve controls the flow of air through the atomizing air passage and a manually adjustable valve controls the amount of air issuing from the horns of the nozzle and thus the degree of fan formed by the atomized spray.

In such systems, it is generally deemed important that both the atomizing air and the fan-shaping air impact the material uniformly, i.e., uniformly around the fluid tip in the first case and uniformly from the opposed air horns in the second case. That is, to form the desired flat fan spray pattern which is uniform in shape, it is important that the flow of air issuing from the air horn ports be equal on both sides. If the flow of air is not equal out of the air horns, the fan pattern will be skewed or asymmetrical. In known electrostatic spray systems, the pressurized air used for forming the fan enters an internal chamber surrounding the fluid tip and passes through passageways in the air horns and out like pairs of exit ports. Because there is typically but one air passageway opening into the internal chamber, the pressurized air must uniformly distribute itself throughout the chamber before entering the air horns so that equal flows of fan-forming air will issue from the opposed horns. By virtue of the way the air cap is mounted to the gun barrel, it is not uncommon for the passageway of one of the air horns be closer to alignment with the air passageway passing through the barrel and opening into the internal air chamber such that an unbalanced air flow occurs between the air horns. Although this may cause some distortion of the fan, in applications where material flow rates were relatively high it is not deemed to materially adversely affect the operation of the gun.

However, more recently, the transfer efficiency of electrostatic spray systems has increased to an extent that it can reduce the amount of paint needed to cover a given surface up to 80%. This corresponds to an increase in transfer efficiency on the order of 400%.

Moreover, the solids content of the paints used today has increased on the order of 200% over that in the past. As a result of the higher efficiency and increased solids content of the paint, the liquid coating material flow rates through the fluid tip have been cut by a factor of 8. With these low flows, which are on the order of less than about 3 fluid ounces of liquid coating material per minute producing fans up to 15 to 22 inches in width at a 14 inch nozzle-to-workpiece distance, the formation of the fan has become critical, and it has been found that very small differences in air flow through the fan-shaping horns seriously affects the fan pattern. Thus, when one of the horns is more closely aligned with the air flow passageway through the barrel, more air can flow through that horn than its opposed horn resulting in unbalanced air flow to the horns and a skewed or asymmetrical fan pattern.

Thus, the problem of controlling the shape of the atomized spray emitted from the gun greatly increases as the flow rate of liquid coating material through the gun decreases. In sum, very small variations in the air flow through the fan-shaping horns have been found to have very drastic effects on the shape of the pattern emitted from the gun.

SUMMARY OF THE INVENTION

It has been among the principal objects of this invention to provide an atomizing nozzle for an electrostatic spray gun having improved distribution of air flow to the fan-shaping horns such that even though one of the horns may be more closely aligned with the fan-forming air passageway through the barrel, the pressurized air to the horns is nevertheless first diffused and equalized to create balanced flows through the opposed air horns.

It has been a further objective of this invention to obtain such improved control and uniformity of fan spray pattern particularly in an electrostatic spray system involving relatively low flow rates, i.e., on the order of less than about 3 fluid ounces of coating material per minute.

It has been a still further objective of this invention to provide a nozzle assembly for electrostatic spray guns which is relatively simple to manufacture but which provides effective diffusion of the fan-shaping air within the air cap to achieve uniformity in the shape of the fan spray pattern.

These objects and others of the present invention are achieved by providing an improved nozzle assembly for electrostatic spray guns including a fluid tip, an air cap, and a retaining ring which cooperate to form an internal air-receiving chamber within the nozzle assembly. A diffuser or diffusion ring is located in this chamber surrounding the fluid tip and defines a plenum into which the outlet to the fan-forming air passageway passing through the barrel opens. The diffusion ring includes an annular flange having a plurality of radially directed holes or openings uniformly spaced about its circumference. As a result, pressurized air entering the chamber first enters the plenum formed by the diffusion ring and is dispersed throughout the plenum, is then redirected in a radially outward direction, and emerges from the multiplicity of uniformly spaced openings. On exiting the diffuser, the air is again redirected in an axial direction into the air receiving chamber and then to the fan-shaping air horns. The pressurized air passing through the spaced openings in the diffusion ring is relatively uniformly dispersed about the circumference of the air-receiving chamber even though the air is discharged into the plenum from the barrel at one fixed point at the end of the barrel. As a result, the fan-forming air passing out of the receiving chamber passes uniformly into the air horns to form a uniform fan pattern of finely atomized liquid coating material. The nozzle assembly of this invention thus provides a uniform fan pattern even when the coating material flow rates are relatively low.

In accordance with a presently preferred form of the invention, the fluid tip is threaded into a counterbore in the forward end of the barrel of the electrostatic spray gun and includes a nozzle portion through which the coating material passes. The air cap has a central bore surrounding the nozzle portion of the fluid tip and includes a pair of opposed fan-forming air horns. The air cap is mounted to the fluid tip by means of an annular retaining ring. These elements cooperate to form a first annular air-receiving chamber surrounding the nozzle portion of the fluid tip and a second annular air-receiving chamber surrounding the fluid tip itself. The first chamber receives pressurized air passing axially through the barrel and axially along the fluid tip to atomize the coating material emitted from the fluid tip. The second chamber receives the pressurized fan-forming air from a passageway passing axially through the barrel of the gun. The air horns include gas flow passages and a pair of exit ports which communicate with the second internal chamber. A diffuser having a central throughopening and a circumferential flange is mounted facing the forward end of the barrel. The threaded rearward portion of the fluid tip passes through the throughopening of the diffuser such that when the fluid tip is threaded into the forward end of the barrel it urges the flange of the diffuser ring against the forward end of the barrel thereby defining a plenum into which the axial air passageway through the barrel opens. Pressurized air passing through the barrel thus enters the plenum and is distributed throughout and about the circumference of the fluid tip. The pressurized air exits the plenum through a plurality of radial openings in the flange which are evenly spaced about the circumference of the diffuser. The air passing radially outwardly of the diffuser impacts the internal surface of the retaining ring and is thereby redirected 90°, i.e., from a radial direction to an axial direction into the second internal chamber. Thus, it may be seen that pressurized air entering the plenum is first redirected 90°, i.e., from axially to radially, and on exiting of the diffuser is again redirected 90°, i.e., from radially to axially. Further, the fan-forming air emerges from the diffuser at a multiplicity of points and in a direction generally perpendicular to the axis of the air passageway through the air horns which reduces the possibility of more direct flow to one air horn than the other. The diffuser thus provides for increased uniformity of distribution of the pressurized air throughout the internal chamber communicating with the passageways and exit ports in the fan-forming horns. Thus, the volume of air passing through the opposed horns is substantially uniform thus creating a uniform fan pattern. This is true even though the passageway of one of the air horns would otherwise be more closely aligned to the axial gas flow passageway through the barrel than the other. In summary, the elements of the nozzle assembly including the fluid tip, air cap, and diffuser ring cooperate to provide a more uniform or balanced distribution of fan-forming air throughout the internal chamber and thus through the air horns to produce a uniform fan pattern of atomized liquid coating material.

DETAILED DESCRIPTION OF THE INVENTION

Figure 1:
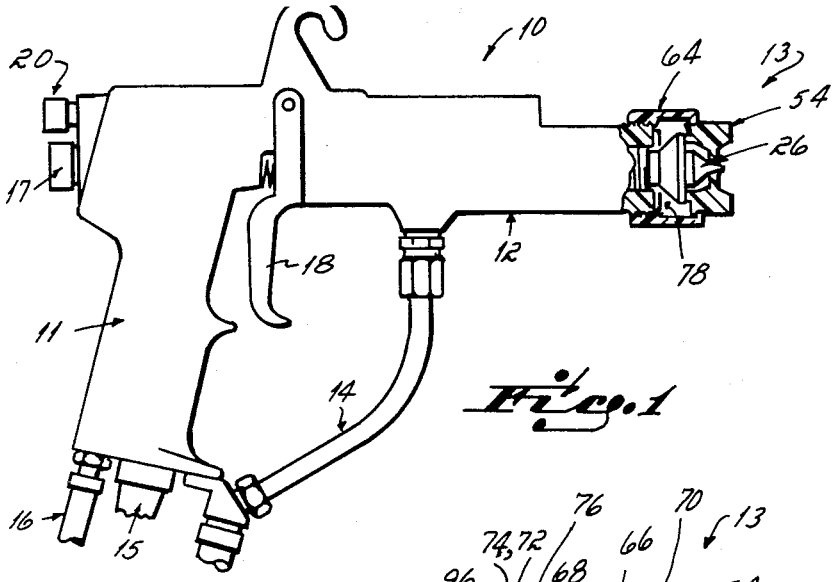
FIG. 1 is a side elevation view showing a manually operated electrostatic air spray gun incorporating the nozzle assembly of this invention (shown in partial cross-section).

The gun 10 illustrated in FIG. 1 of the drawings is an air operated electrostatic spray gun which relies upon the impact of an air stream with a liquid stream to effect atomization of the liquid stream. While the invention is described as applied to a hand-held spray gun, it should be understood that the invention is equally applicable to electrostatic spray guns which are fixed or which are fixed to mechanical gun movers which may reciprocate the guns to coat the workpiece.

The gun 10 shown in FIG. 1 is described in detail in the Hastings U.S. Pat. No. 4,241,880, which description is incorporated herein by reference. The gun is generally described here only for purposes of illustrating the application of the present invention, and those skilled in the art are referred to the aforementioned patent for the details of its construction and operation.

Briefly, however, the gun 10 comprises an electrically conductive metal handle assembly 11, an electrically insulative barrel assembly 12, and an electrically insulative nozzle assembly 13. The nozzle assembly is made of an electrically non-conductive material such as an acetyl homopolymer commonly known by the du-Pont trademark "Delrin." Delrin 500 and 550 are presently preferred materials of construction for the nozzle assembly. Paint or other spray material which may be in the nature of a coating, varnish, or lacquer (referred to in regard to this invention generically as "paint") is supplied to the gun from an external reservoir or tank (not shown) through a material passage 14. A high voltage source of electrical energy is supplied to the gun by a cable 15 from an external electrical power pack (not shown).

The handle assembly 11 is generally made from a metal casting and includes an air inlet 16, a trigger actuated internal air flow control valve 17, and a trigger 18 for controlling the flow of air through the valve 17. There is also an adjustable air valve 20 in the gun handle for controlling the shape or "fan" of the spray emitted from the gun.

Figure 2:
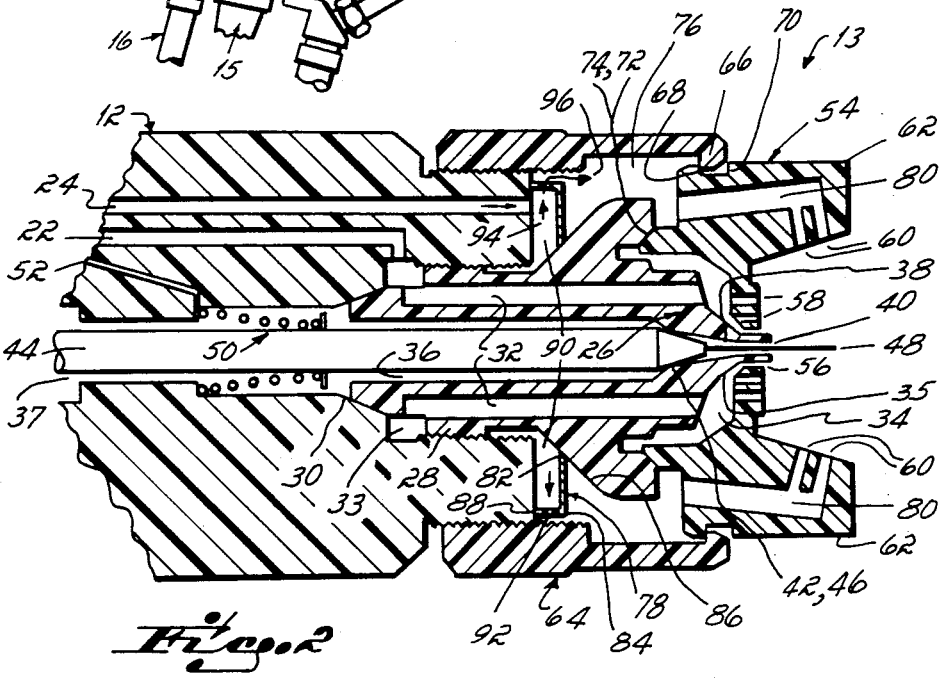
FIG. 2 is an axial cross-sectional view of the nozzle portion of the electrostatic spray gun shown in FIG. 1.

The air inlet 16 opens into a generally vertical air passage in the handle 11 which communicates through the air flow control valve 17 with a pair of internal passages 22, 24 passing through the barrel of the gun and terminating at the forward end of the barrel 12 (FIG. 2). The passage 22 provides the atomizing air while passage 24 provides the fan-shaping air. The flow of air through passages 22, 24 is controlled by the trigger operated air control valve while the flow of fan air through the passage 24 is further controlled by the fan control valve 20.

Alternatively and particularly where low coating material flows are involved, the gun may include separate air streams for atomizing the liquid material and shaping the atomized spray into a desired fan pattern with separate signal-controlled valves independently controlling the liquid coating flow rate, atomization air stream flow rate, and fan-shaping air stream flow rate. Such a system is shown in U.S. Ser. No. 367,855, filed Apr. 13, 1982, assigned to the assignee of this invention, and abandoned in favor of File Wrapper Continuation Application Ser. No. 583,487.

Figure 3:
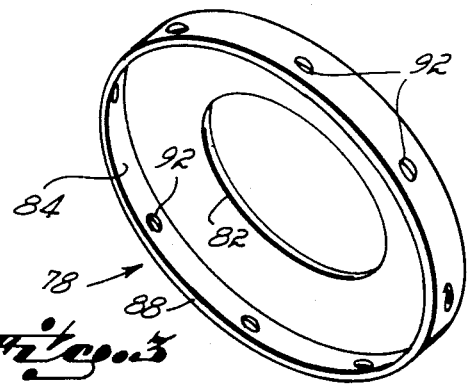
FIG. 3 is a perspective view of the diffuser shown in FIGS. 1 and 2.

Referring now to FIGS. 2 and 3, the nozzle assembly 13 is made from an electrically non-conductive material. It has a fluid tip 26 which is threaded at its rear 28 into a counterbore 30 in the forward end of the barrel 12. The fluid tip 26 has six circumferentially spaced axial passages 32 which open into the rear 33 of the counterbore 30 which in turn communicates with the air passage 22 such that coating material atomizing air passing through the passage 22 may enter and pass through the rear 33 of the counterbore 30, the axial passages 32 in the fluid tip 26, and into an internal chamber 34 surrounding the forward end 35 of the fluid tip. The fluid tip 26 also has a central axial passage 36 communicating with a material flow passage 37 in the gun 10 for supply of liquid or fluid by the inclined passage 14 (FIG. 1) from the tank or reservoir.

The forward end 35 of the fluid tip 26 terminates in a nozzle 38 having a small diameter orifice 40 through which the coating material is emitted. The fluid tip 26 further includes a coned seat 42 formed inside the nozzle 38 close to the discharge orifice 40. The flow of paint through the axial flow passageway 36 is controlled by a control rod 44. The control rod 44 is mounted at its rear and is axially slidable in a forward and rearward direction upon operation of the trigger 18. The control rod 44 terminates at its forward end in a coned shaped tip 46. The coned tip 46 cooperates with the internal seat 42 in the fluid nozzle 38 to form a needle and seat valve assembly actuable by the trigger 18. That is, when the trigger 18 is pulled rearwardly, the rod is retracted which retracts the coned-shaped tip 46 of the rod 44 from the valve seat 42 immediately behind the material discharge orifice 40 allowing paint in the passageway 36 to flow around the tip 46 and out the discharge orifice 40. When the trigger is released, a spring (not shown) moves the control rod 44 forwardly with the tip 46 engaging the valve seat 42 to thereby stop the flow of paint.

A material charging electrode or antenna 48 is mounted on the center axis of the fluid tip 26 and is held in place by the coned-shaped end 46 of the control rod 44. This end of the charging electrode is in electrical connection with a resistor (not shown) within the control rod 44 which is in turn in electrical connection through a conical spring and pin arrangement 50 with a small electrical conductor 52. The conductor 52 passes through the barrel 12 of the gun and is in turn connected to the source of electrical energy supplied to the gun by the cable 15. The details of the charging elements are described in the aforementioned patent, U.S. Pat. No. 4,241,880.

An air cap 54 surrounds the forward end 35 of the fluid tip 26. It includes a central bore 56 through which the nozzle 38 extends, two pair of fan control ports 58 located on either side of the bore, two pair of recessed fine atomizing ports (not shown) and a pair of ports 60 in each air horn 62. Pressurized air passes through the axial passages 32 and into the internal chamber 34 and thereafter passes through the fine atomizing and fan control ports 58 surrounding the center bore 56 where the air impacts the stream of liquid coating material emitted from the fluid tip orifice 40 to atomize it into a finely dispersed spray of liquid coating material.

The air cap 54 is mounted to the gun 10 by means of an annular retaining ring 64. The retaining ring 64 is also made of electrically non-conductive material. It is threaded over a threaded section of the barrel 12 at one end and its other end has an annular lip 66. The retaining ring 64 although rigid is sufficiently flexible at the lip 66 to permit the air cap 54 to be snapped into position with the lip 66 engaging a wall 68 in an annular groove 70 in the outside surface of the air cap 54 such that the air cap is securely retained and sealed against escape of air to the atmosphere. The air cap and fluid tip include mating frustoconical surfaces 72 and 74, respectively, which seal the atomizing air in the chamber 34 from the fan-shaping air in a second annular chamber 76 when the retaining ring 64 is securely tightened on the barrel 12. The chamber 76 communicates with the air passage 24 through a diffuser 78 and with passages 80 in the air horns 62 in turn communicating with the ports 60.

Referring in addition to FIG. 3, the diffuser 78 is annular or ring-shaped and is mounted within the chamber 76 surrounding the outer circumference of the fluid tip 26 at the forward facing end of the barrel 12. The diffuser 78 includes a center throughopening 82 and a circumferentially extending flange 84. The threaded portion 28 of the fluid tip 26 passes through the throughopening 82 such that when the fluid tip is threaded into position in the forward end of the barrel, the circumference of the throughopening engages the conical surface 86 of the fluid tip 26 to tightly urge the facing edge 88 of the flange 84 against the forward end of the barrel 12. The diameter of the diffuser 78 is such that the flange 84 lies radially outwardly of the location at which the air passage 24 opens at the forward end of the barrel. The diffuser 78 in cooperation with the fluid tip 26 and barrel 12 forms a plenum 90 for receiving the pressurized air from the passageway 24. A series of radial openings 92 are uniformly spaced about the circumference of the flange 84. These openings 92 permit the flow of pressurized air from the plenum 90 into the chamber 76. As shown in FIG. 3, in one presently preferred form of the invention, the diffuser 78 includes eight evenly spaced openings 92 about 1/16 inch in diameter each separated by an arc of 45°.

As may be seen referring again to FIG. 2, pressurized air exiting the passageway 24 and entering the plenum 90 is redirected 90° in direction, i.e., from an axial direction to a radial direction and caused to flow circumferentially about the outer surface of the fluid tip to fill the plenum 90 (shown by direction of arrows 94). Air being under pressure then passes radially outwardly through the openings 92 (shown by arrow 96) where it impacts the circmferential inner surface of the retaining ring 64 and is again redirected 90° in direction, i.e., from a radial direction to an axial direction (see arrow 96). This causes even distribution of pressurized air entering the chamber 76. The pressurized air in the chamber 76 in turn passes through the passageways 80 in the air horns 62 to the exit ports 60 in the air horns 62. The pressurized air issuing from the opposed air horns 62 shapes the conical spray pattern of atomized material issuing from the fluid tip 26 into a flat fan. It may be appreciated that because the air is more uniformly and evenly distributed through the chamber 76 prior to entering the air horns 62 that the flow of air into and out of the air horns 62 will be more uniform thus contributing to a more uniform fan pattern. This is the case even though (because of the way the air cap is mounted to the fluid tip) one of the passageways 80 in an air horn 62 would otherwise be in closer alignment with the passage 24, as is illustrated by FIG. 2 reference being had to the upper passageway 80. However, as shown, the diffuser 78 prevents non-uniform flow to the upper air horn (as shown in FIG. 2) as opposed to the lower air horn by redirecting the flow of air from passageway 24 first from an axial direction to a radial direction and about the fluid tip filling the plenum 90 and then uniformly radially outwardly from a multiplicity of points and then, in turn, in an axial direction to uniformly enter the chamber 76.

Although the invention has been described in terms of certain preferred embodiments, those skilled in the art will recognize that other forms may be adopted within the scope of the invention.

What is claimed is:

1. In an electrostatic spray coating apparatus adapted to be connected to a source of liquid coating material for providing relatively low liquid coating material flow rates in the approximate range of less than about three fluid ounces of material per minute said apparatus including a nozzle having an orifice from which liquid coating material is emitted in the form of an atomized spray, means for electrostatically charging the liquid coating material emitted from said orifice, and fan-shaping means for impinging the atomized spray of liquid coating material emitted from said orifice with pressurized air to form a fan-shaping pattern of said atomized liquid coating material, said fan-shaping means including a gas flow passageway for delivering pressurized air to an internal chamber generally axially of said nozzle and opposed exit ports communicating with said chamber through which said pressurized air passes to form the fan-shaped pattern, the improvement comprising:

an annular diffuser located in said chamber having a circumferential flange lying radially outwardly of the location where said gas flow passageway delivers pressurized air to said internal chamber and extending generally axially of said gas flow passageway and defining an annular plenum within said internal chamber for receiving pressurized air from said gas flow passageway and including a plurality of circumferentially spaced, radially directed openings in said flange through which said pressurized air in said plenum passes radially outwardly to enter said chamber at a plurality of circumferentially spaced locations, said diffuser changing the direction of flow of said pressurized air from the generally axial flow into the nozzle and into said plenum to a generally radial outward flow exiting said openings.

2. The electrostatic spray coating apparatus of claim 1 wherein said pressurized air is redirected 90° upon entering said plenum and again 90° on exiting said openings.

3. In an electrostatic spray coating apparatus adapted to be connected to a source of liquid coating material for providing relatively low liquid coating material flow rates in the approximate range of less than about 3 fluid ounces of fluid of material per minute said apparatus including a barrel having a gas flow passageway through which pressurized air passes, a fluid tip threaded at its rear end into said barrel and having an orifice at its forward end from which liquid coating material is emitted in the form of an atomized spray, means for electrostatically charging the liquid coating material emitted from said orifice, and an air cap mounted to and surrounding at least the forward end of said fluid tip, said air cap including opposed air horns having internal gas flow passageways for delivering pressurized air to opposed exit ports in said air horns for impinging the atomized spray of liquid coating material emitted from said orifice with pressurized air to form a fan-shaped pattern of said atomized liquid coating material, and an annular retaining ring mounting said air cap to said fluid tip, said fluid tip, retaining ring and air cap defining an annular internal chamber for receiving pressurized air from said gas flow passageway in said barrel and delivering said pressurized air to said passageways in said air horns, the improvement comprising an annular diffuser located in said internal chamber, said diffuser including a throughopening through which said rear end of said fluid tip passes to locate and mount said diffuser in said chamber and a circumferential flange having a facing edge contacting the forward end of the barrel, said diffuser defining with said forward end of said barrel and said fluid tip, an annular plenum surrounding said fluid tip, said diffuser further including a plurality of circumferentially spaced, radially directed openings in said circumferential flange, said diffuser being operative to direct pressurized air entering said plenum to a radial and circumferential direction, said air exiting said diffuser through said spaced openings in a radially outward direction and impacting said retaining ring and being directed thereby generally axially into said internal chamber, the flow of air through the spaced openings being in a direction generally perpendicular to the axes of the gas flow passageways in said air horns.

4. In an electrostatic spray coating system of the type which includes a spray gun adapted to be connected to a source of liquid coating material for providing relatively low liquid coating material flow rates in the approximate range of less than about 3 fluid ounces of material per minute, said gun including a coating material passage terminating in an outlet orifice from which liquid coating material is emitted in the form of an atomized spray, electrical circuit means for charging the liquid coating material emitted from said orifice, and a gas flow passageway terminating in an outlet orifice communicating with an air cap having a pair of opposed air horns for impinging the atomized spray of liquid coating material emitted from said orifice with pressurized air to form the spray into a fan-shaped pattern, the method of delivering pressurized air to said air cap comprising the steps of:

passing pressurized air axially along said gun to said outlet orifice, redirecting the flow direction of said air in a radial and circumferential direction, diffusing said air about a 360° annulus, redirecting the flow of said air from said 360° annulus to a direction of the axial flow along said gun, and delivering said diffused and redirected flow of pressurized air to said air horns.

5. In an electrostatic spray coating system of the type which includes a spray gun adapted to be connected to a source of liquid coating material for providing relatively low liquid coating material flow rates in the approximate range of less than about 3 fluid ounces of material per minute, said gun including a coating material passage terminating in an outlet orifice from which liquid coating material is emitted in the form of an atomized spray, electrical circuit means for charging the liquid coating material emitted from said orifice, and a gas flow passageway terminating in an outlet orifice communicating with an air cap having a pair of opposed air horns for impinging the atomized spray of liquid coating material emitted from said orifice with pressurized air to form the spray into a fan-shaped pattern, the method of delivering pressurized air to said air cap comprising the steps of:

passing pressurized air axially along said gun to said outlet orifice, passing said pressurized air exiting said outlet orifice into a plenum, causing said pressurized air to flow in a radial and circumferential direction within said plenum, causing said pressurized air to exit said plenum in a radially outward direction at a multiplicity of spaced locations, redirecting the flow of said pressurized air in an axial direction, and delivering said pressurized air to said air horn.

6. In a spray coating apparatus adapted to be connected to a source of liquid coating material for providing relatively low liquid coating material flow rates in the approximate range of less than about three fluid ounces of material per minute said apparatus including a nozzle having an orifice from which liquid coating material is emitted in the form of an atomized spray, and fan-shaping means for impinging the atomized spray of liquid coating material emitted from said orifice with pressurized air to form a fan-shaped pattern of said atomized liquid coating material, said fan-shaping means including a gas flow passageway for delivering pressurized air to an internal chamber generally axially of said nozzle and opposed exit ports communicating with said chamber through which said pressurized air passes to form the fan-shaped pattern, the improvement comprising:

an annular diffuser located in said chamber having a circumferential flange lying radially outwardly of the location where said gas flow passageway delivers pressurized air to said internal chamber and extending generally axially of said gas flow passageway and defining an annular plenum within said internal chamber for receiving pressurized air from said gas flow passageway and including a plurality of openings in said flange through which said pressurized air in said plenum passes radially outwardly to enter said chamber at a plurality of circumferentially spaced locations, said diffuser changing the direction of flow of said pressurized air from the generally axial flow into the nozzle and into said plenum to a generally radial outward flow exiting said openings.

7. In a spray coating system of the type which includes a spray gun adapted to be connected to a source of liquid coating material for providing relatively low liquid coating material flow rates in the approximate range of less than about 3 fluid ounces of material per minute, said gun including a coating material passage terminating in an outlet orifice from which liquid coating material is emitted in the form of an atomized spray, and a gas flow passageway terminating in an outlet orifice communicating with an air cap having a pair of opposed air horns for impinging the atomized spray of liquid coating material emitted from said orifice with pressurized air to form the spray into a fan-shaped pattern, the method of delivering pressurized air to said air cap comprising the steps of:

passing pressurized air axially along said gun to said outlet orifice, redirecting the flow direction of said air in a radial and circumferential direction, diffusing said air about a 360° annulus, redirecting the flow of said air from said 360° annulus to a direction of the axial flow along said gun, and delivering said diffused and redirected flow of pressurized air to said air horns.

* * * * *